US006887011B2

(12) United States Patent
Snagel

(10) Patent No.: US 6,887,011 B2
(45) Date of Patent: May 3, 2005

(54) PAVEMENT MARKER WITH ENHANCED DAYTIME SIGNAL

(75) Inventor: Paul Snagel, Chicago, IL (US)

(73) Assignee: Avery Dennison Corporation, Pasedena, CA (US)

( * ) Notice: Subject to any disclaimer, the term of this patent is extended or adjusted under 35 U.S.C. 154(b) by 0 days.

(21) Appl. No.: 10/632,384

(22) Filed: Aug. 1, 2003

(65) Prior Publication Data

US 2005/0025570 A1 Feb. 3, 2005

(51) Int. Cl.[7] ..... E01F 9/04
(52) U.S. Cl. ..... 404/14; 404/16; 359/551
(58) Field of Search ..... 404/9, 12, 13, 404/14, 15, 16; 359/531, 551; D10/113

(56) References Cited

U.S. PATENT DOCUMENTS 4,040,760 A * 8/1977 Wyckoff ..... 404/14
4,069,787 A * 1/1978 Wyckoff ..... 116/63 R
4,498,733 A 2/1985 Flanagan
5,013,181 A * 5/1991 Harrison ..... 404/12
5,393,166 A * 2/1995 Stock et al. ..... 404/14
6,126,360 A * 10/2000 May et al. ..... 404/14
6,511,256 B1 * 1/2003 Flader et al. ..... 404/13
6,558,069 B1 * 5/2003 Flader et al. ..... 404/13

FOREIGN PATENT DOCUMENTS

CH 275346 5/1951
DE 35 26 597 A1 2/1987
GB 2 139 674 * 11/1984

* cited by examiner

*Primary Examiner*—Gary S. Hartmann
(74) *Attorney, Agent, or Firm*—Gerald E. Hespos; Anthony J. Casella

(57) ABSTRACT

A pavement marker includes a base and at least one lens with retroreflective areas aligned to reflect headlights back toward a vehicle for producing a nighttime signal. The lens and/or the base are formed from resins that include a fluorescent material. At least a portion of the lens is free of the retroreflective areas so that the fluorescent material of the lens and/or the base produces a daytime signal emitted from or through the lens.

13 Claims, 4 Drawing Sheets

PAVEMENT MARKER WITH ENHANCED DAYTIME SIGNAL

BACKGROUND OF THE INVENTION

1. Field of the Invention

The invention relates to a pavement marker that reflects and/or transmits light to identify selected regions of a driving lane.

2. Description of the Related Art

Traffic safety engineers design roads to give drivers a limited and predictable range of visual cues in an effort to generate predictable responses to those cues. The visual cues relate primarily to the shapes, colors and locations of traffic control devices. Standards for traffic control devices are specified in the Manual of Uniform Traffic Control Devices (MUTCD). The colors employed most widely in traffic control devices are white, red, yellow, fluorescent yellow-green and fluorescent orange.

White traffic control devices typically are employed on the traffic lane markings to identify the right edge of a travel lane or the demarcation between two travel lanes that permit travel flow in the same direction. Yellow is a warning indicator and is employed in travel lane markings to identify a demarcation between opposite flows of traffic. Thus, the center lane of a two-lane road will have a yellow stripe while each pavement edge of the two-lane road will have a white stripe. Red is used when a driver is required to stop or yield. For example, stop signs and yield, signs include white lettering on a red background. Red reflectors also are used to indicate that a driver is traveling in the wrong direction or to mark dangerous structures that a driver must avoid. Fluorescent yellow-green has been adopted more recently by the Manual of Uniform Traffic Control Devices to identify school crossing zones. Orange is recognized by the Manual of Uniform Traffic Control Devices to identify construction zones. Thus, orange signs may be used to announce the presence of a construction zone or to guide drivers through a construction zone.

Highway engineers often utilize pavement markers to help control traffic. A typical pavement marker has a base that is mounted to a surface of a roadway or that is embedded into the surface of the roadway. The pavement marker may also include at least one resin panel designed and oriented to produce optical signals in response to ambient light during daylight hours or headlights at night. More particularly, some panels are translucent and generate internal reflection of most of the light that impinges upon a major surface of the panel. The internally reflected light is emitted from an edge of the panel and produces a visually apparent glow along the edge. Panels of this type can be oriented with a major surface aligned to receive a maximum amount of ambient light and with an edge facing toward the driver. These panels can be effective during daylight, but have little effect at night. Other panels are configured with a matrix of rear surfaces aligned to reflect light toward the source of the light within certain ranges of angles of incidence. Thus, light emitted from the vehicular headlight will pass through the front surface and will be reflected back toward the driver. These panels are effective at night, but have little effect during the day.

The panels of pavement markers that redirect and/or reflect light may include a dye, pigment or colorant that will affect the color of the signal directed towards the driver. For example, a substantially transparent resin will reflect and/or transmit light that includes substantially the entire visible spectrum and will be perceived as a white signal. Transparent reflectors often are incorporated into pavement markers disposed along the shoulder of a road and are substantially coincident with a painted white line along the shoulder of the road. Thus, the reflected light will be perceived as a white signal and will supplement the white signal defined by the white line painted adjacent the right edge of the pavement. Resin panels that are dyed or colored yellow can be incorporated into pavement markers along the left edge of a one-way road and/or to indicate a demarcation between two oppositely flowing lanes of traffic. Similarly, red-dyed resin is used in reflectors that instruct a driver to stop or yield.

Some pavement markers include translucent or opaque panels with a fluorescent colorant. The fluorescent materials are excited in response to light energy impinging thereon and emit photons. Photons emitted from an opaque fluorescent material can be observed by a viewer spaced considerably from the opaque fluorescent material. Photons emitted by a translucent fluorescent material can be emitted from the edge to produce the above-described edge glow. Other panels have a fluorescent colorant and the above-described matrix of rear reflective surfaces. Thus the fluorescent light will be reflected back toward a driver. Fluorescent colorants can be selected to produce a fluorescent yellow-green optical signal in a school zone or fluorescent orange optical signal in a construction zone.

Some pavement markers are required primarily for their nighttime signal, such as those that mark the lane lines. Others are required primarily for a daytime signal, such as those used in a school zone. Many construction projects require traffic to be diverted both during the day and at night while a repair is being completed. For example, roadway resurfacing projects typically require at least one lane of a road to be closed while a section of roadway is removed and replaced. Similar lane-by-lane closures occur when a bridge surface must be replaced. A pavement marker used in these situations must be effective in both the day and might.

The assignee of the subject invention also owns U.S. Pat. No. 6,511,256 which covers a pavement marker with improved daytime visibility and fluorescent durability. The pavement marker includes a base, a top panel for producing a daytime edge glow signal and a front panel for producing a reflective nighttime signal. U.S. Pat. No. 6,511,256 discloses a specific fluorescent orange colorant in an acrylic resin to provide a daytime signal for identifying a construction zone.

A top panel and a retroreflective front panel must be secured to the base of the pavement marker in a manner that will withstand frequent impact by vehicular tires. The attachment of the panels to the base has been achieved by mechanical fasteners, adhesives and by ultrasonic welding.

The pavement marker disclosed in the above-referenced U.S. Pat. No. 6,511,256 offers many desirable features relating to improved daytime visibility and the durability of the fluorescents. However, a pavement marker that can provide both a strong nighttime signal and an even stronger daytime signal, such as a signal indicative of a construction zone or school zone, would be received favorably.

SUMMARY OF THE INVENTION

The invention relates to a roadway marker having a base with a bottom surface for secure mounting to or in a surface, such as a pavement surface. The base also includes a top surface and a front surface. The top surface may be aligned substantially parallel to the surface on which the marker will be installed. The front surface may be aligned at an acute angle to the surface on which the marker is mounted. The base may be formed from an opaque resin and preferably an opaque resin with fluorescent dye or colorant. The dye or colorant used in the base is intended to produce an optical signal with an appropriate traffic control effect, e.g. fluorescent orange for a construction zone.

The marker may further include a top panel secured to the top surface of the base. The top panel may have a top surface aligned for receiving ambient light and an edge facing generally toward the front of the marker. The top panel may be formed from a resin that will internally reflect a portion of the light impinging upon the fop surface of the top panel and/or a portion of the photons emitted from fluorescent colorants in the top panel. At least a portion of the internally reflected light will be emitted from the front edge of the panel to produce a visually apparent edge glow that can be seen during daylight hours by a driver approaching the front of the marker. The resin used for the top panel may be an acrylic and may be blended with an appropriate colorant so that the panel receives ambient light and emits an edge glow that is perceived as an appropriate traffic control device, such as fluorescent orange for a construction zone or a fluorescent yellow-green for a school zone. The colorant preferably is a fluorescent dye and preferably is selected and/or blended to produce an edge glow with coordinates on a CIE diagram that correspond to the required traffic control device.

The marker further includes a retroreflective panel secured on the front face of the panel. The retroreflective panel also may be formed from a resin blended with colorant to match the dye or colorant in the base. The colorant in the retroreflective panel may be a fluorescent colorant, such as a fluorescent orange for use in a construction zone. The front panel will be used partly as a nighttime traffic control device that reflects light from a vehicle headlight back toward the vehicle. The reflected light will have a traffic control effect determined by the particular colorant.

The retroreflective front panel also receives ambient light during daytime hours. A small portion of the ambient light will strike the panel at an angle that will permit the light to reflect toward oncoming vehicles. However, under normal conditions this retroreflected daytime light will be small and will not be perceived by a driver.

The retroreflective front panel preferably is secured to the base by ultrasonic welding. Ultrasonic welding is carried out with sound energy that causes molecules in the panel and base to vibrate sufficiently to generate heat for softening or melting the resin. Ultrasonic welding works best when the energy can be focused at a specified location. Such focusing can be achieved if the object that is to be welded has a narrow edge or projection. The retroreflective panel or the base of the subject pavement marker may be formed with a plurality of projections that function as directors for the ultrasonic energy. The projections or energy directors may be aligned parallel to the flow of traffic. The projections and/or the ultrasonic welding will locally impair the reflectivity of the rear surface of the front panel. However, the fluorescent materials of the front panel and/or the base at these locations will produce an optical signal in response to ambient light, and that signal will be visible to a driver during daytime hours. The signal produced by the energy directors on the retroreflective panel will contribute to the daytime optical signal produced by the top panel, if present, and/or the reflective or fluorescent optical signal produced by the base.

The strength of a nighttime signal produced by the front retroreflective panel is reduced as the density of energy directors increases. Normally there is no incentive to reduce the nighttime effectiveness of the retroreflective panel on a pavement marker. However, traffic control devices, such as pavement markers, typically are used in close proximity to one another through construction zones. As a result, an adequate nighttime signal can be produced in a construction zone due to the closer spacing between pavement markers typically employed in a construction zone. On the other hand, stronger daylight signals in construction zones would be helpful. Similarly, a stronger daytime signal would be helpful in school zones to correspond to the times when children are likely to be present. The strength of the daylight signal is enhanced by adding the fluorescence of the energy directors to the edge glow of the top and/or the reflective or fluorescent optical signal produced by the base.

DETAILED DESCRIPTION OF THE PREFERRED EMBODIMENTS

Figure 1:
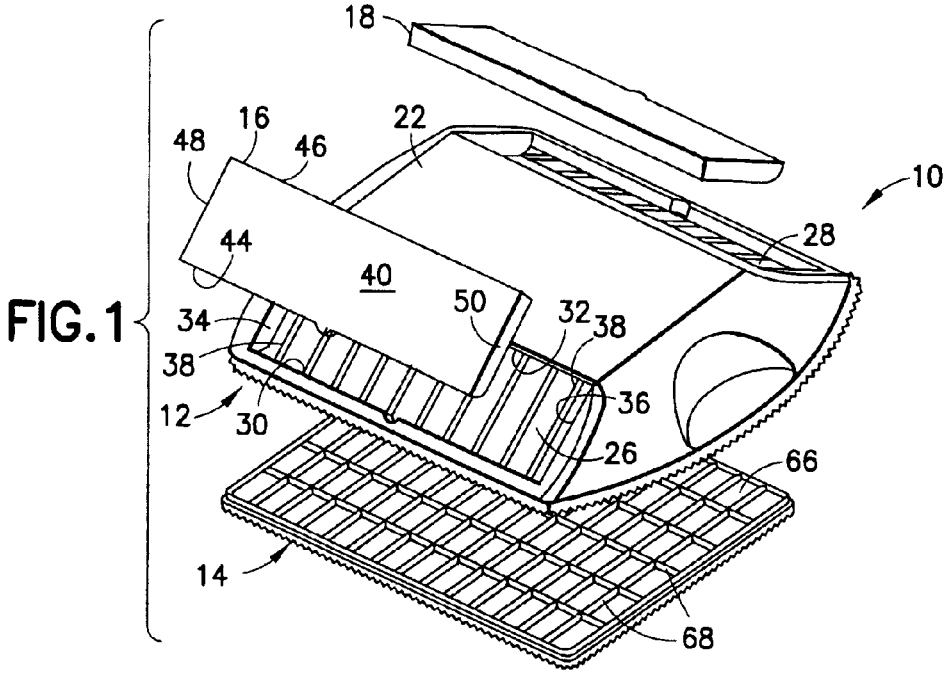
FIG. 1 is an exploded perspective view of a pavement marker in accordance with a first embodiment of the subject invention as viewed from the top of the pavement marker.
Figure 2:
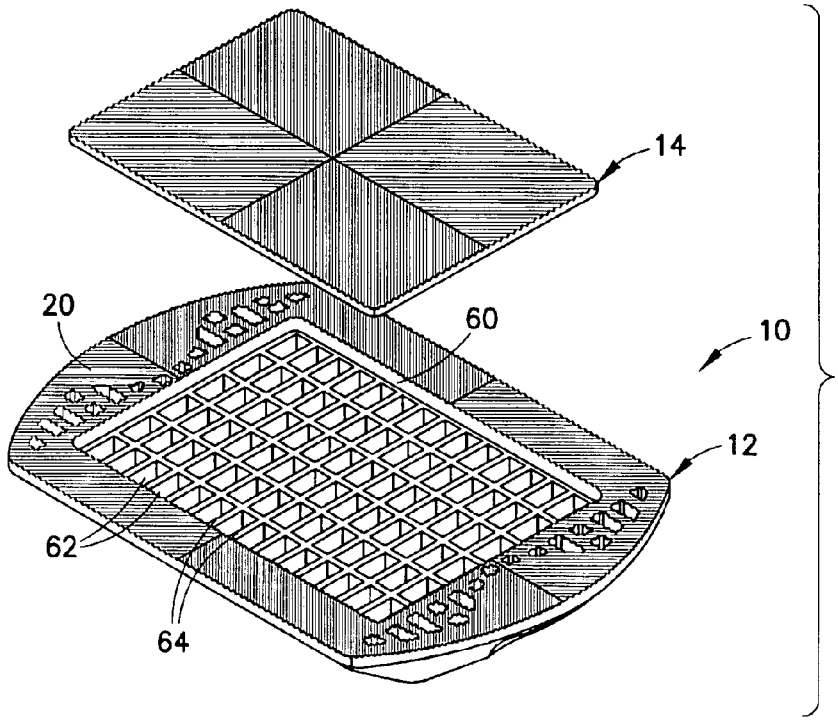
FIG. 2 is an exploded perspective view of the pavement marker of FIG. 1 as viewed from the bottom of the pavement marker.

A pavement marker in accordance with the subject invention is identified generally by the numeral 10 in FIGS. 1–12. The pavement marker 10 includes a base 12, a bottom cover 14 and front and rear lenses 16 and 18. The base 12 is molded unitarily from an opaque fluorescent thermoplastic material and includes a bottom 20, as shown most clearly in FIG. 2 and an opposed top 22 as shown most clearly in FIG. 1. The top 22 is formed with front and rear lens recesses 26 and 28 for receiving the front and rear lenses 16 and 18 respectively. The lens recesses 26 and 28 are substantially identical. In many embodiments only a front lens 16 will be required, and hence the base will have no rear lens recess 28. Thus, for convenience only the front lens recess 26 is described in detail herein. More particularly, the front lens recess 26 defines a substantially wide rectangle with a bottom edge 30, a top edge 32 and opposite side edges 34 and 36. The front lens recess 26 is sloped relative to the top surface 22 and relative to the surface of the pavement on which the marker 10 will be positioned. The slope is oriented so that the bottom edge 30 of the lens recess 26 is in a more forward positioned than the top edge 32. Grooves 38 that are of trapezoidal cross section are formed in the lens recess 26. The trapezoidal cross section is oriented so that the base of each groove 38 is narrower than the top opening into the groove 38 to facilitate molding. Each groove 38 preferably has a depth "a" of about 0.01–0.03 inch and most preferably about 0.018 inch. In this embodiment, the grooves 38 are oriented in a front to rear direction. Thus, the grooves 38 extend substantially perpendicular to the bottom and top edges 30 and 32 of the lens recess 26.

The front lens 16 is formed from a translucent resin blended with a colorant, such as fluorescent orange, fluorescent yellow-green or some other color recognized by the MUTCD. The front lens 16 is substantially rectangular and is dimensioned to fit into the front lens recess 26. More particularly, the front lens 16 is a wide rectangle with a front surface 40, a rear surface 42, a bottom edge 44, a top edge 46, and left and right edges 48 and 50. The upper surface 40 is substantially planar. The rear surface 42, however, is non-planar and is formed with a plurality of facets aligned so that light passing through the front surface 40 within a narrow range of angles is reflected off one facet on the rear surface 42 and back through the front surface 40. This aspect of the front lens 16 may be manufactured in accordance with known technology for retroreflective panels on a pavement marker and functions to reflect headlights from a vehicle back toward vehicle.

Figure 6:
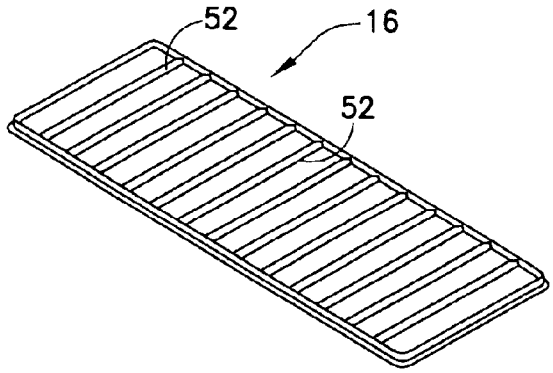
FIG. 6 is a perspective view of the reflective lens panel as viewed from the bottom.
Figure 7:
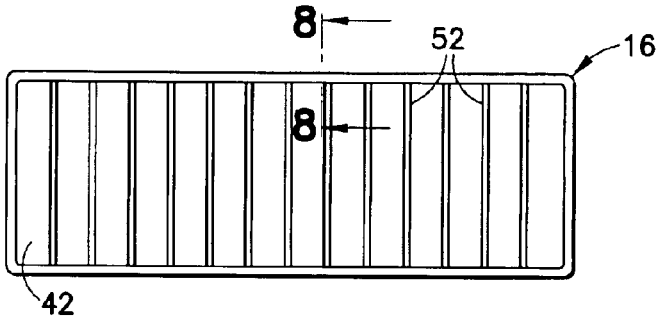
FIG. 7 is a bottom plan view of the reflective lens panel.
Figure 8:
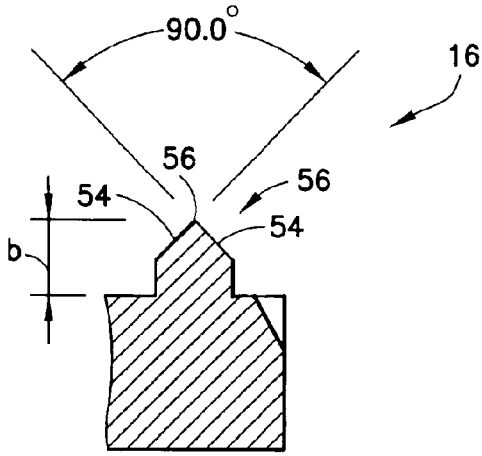
FIG. 8 is a cross-sectional view taken along line 8—8 in FIG. 7.
Figure 9:
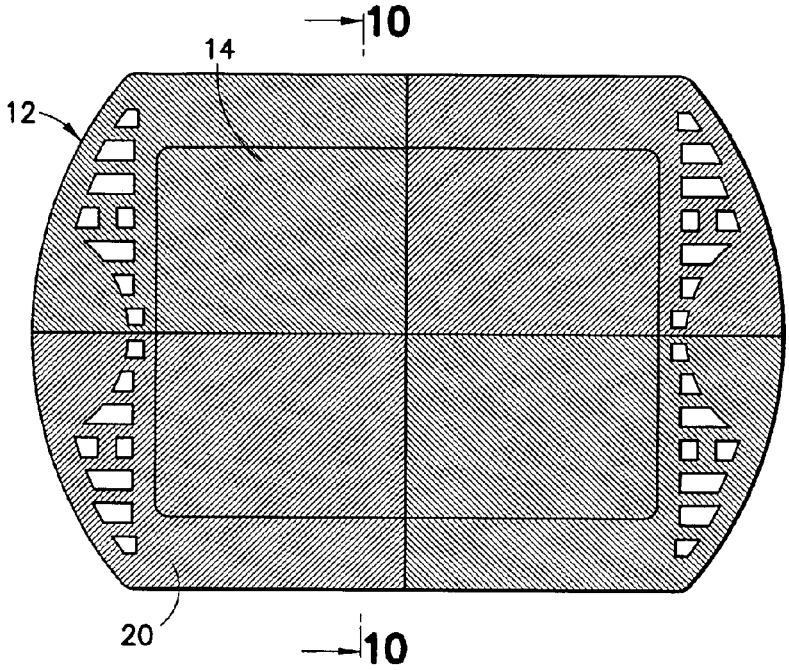
FIG. 9 is a top plan view of the assembled pavement marker.
Figure 10:
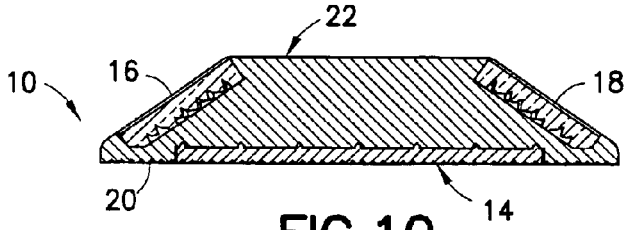
FIG. 10 is a cross-sectional view taken along line 10—10 in FIG. 9.

The rear surface 42 of the front lens 16 further is formed with a plurality of energy directors 52, as shown in FIGS. 6–8. The energy directors 52 are in the form of ridges disposed to register with the grooves 38 in the lens recess 26. Each energy director 52 includes a pair of converging surfaces 54 that meet along a substantially linear edge 56. The maximum width defined by the surfaces 54 is less than the width of the corresponding groove 38 in the lens recess 26. The height of each energy director 52 is approximately 0.03–0.04 inch, and hence slightly exceeds the depth of the corresponding groove 38 in the lens recess 26.

Figure 3:
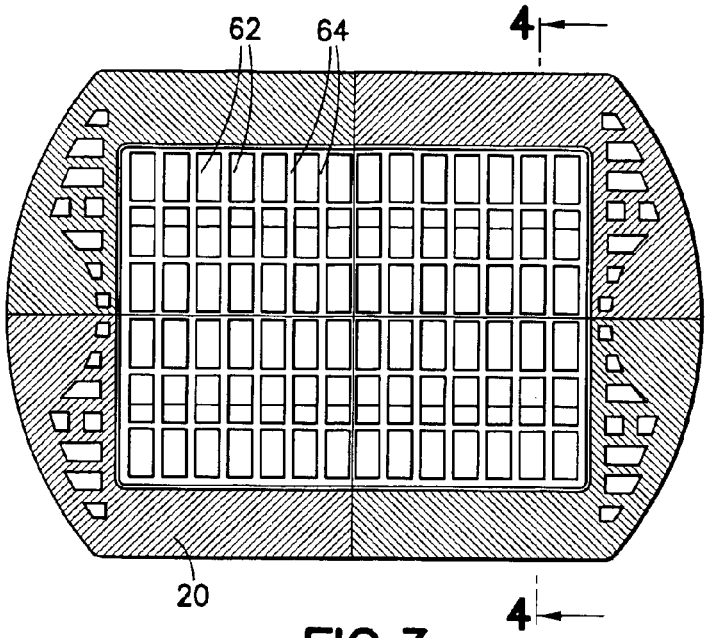
FIG. 3 is a bottom plan view of the base of the pavement marker.
Figure 4:
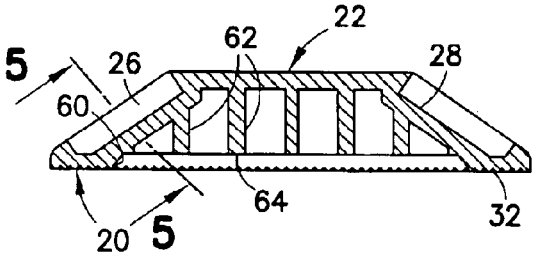
FIG. 4 is a cross-sectional view taken along line 4—4 in FIG. 3.
Figure 5:
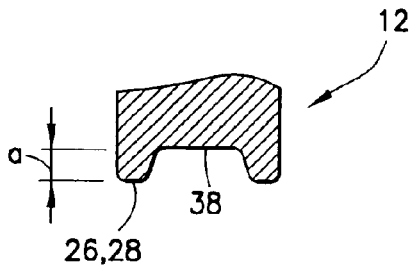
FIG. 5 is a cross-sectional view taken along line 5—5 in FIG. 4.

The bottom surface 20 of the base 12 is formed with a recess 60 for receiving the bottom cover 14, as shown in FIGS. 3–5. Coring holes 62 extend up into the bottom surface 20 of the base at locations aligned with the recess 60 and are separated from one another by webs 64. The coring holes 62 are formed to provide substantially uniform thickness of plastic throughout the base 12 for molding efficiency and uniform curing. Bottom surfaces of the webs 64 and peripheral regions of the recess 60 are formed with grooves substantially identical to the grooves 38 formed in the lens recesses 26 and 28. The bottom cover 14 has a top surface 66 formed with energy directors 68 that nest in the grooves in the webs 64 and around the periphery of the recess 60. The energy directors 68 in the top surface 66 of the bottom cover 14 are configured substantially identically to the energy directors 52 formed on the lenses 16 and 18. The bottom 20 of the base 12 and the bottom surface of the bottom cover 14 each are formed with an array of grooves and ribs to maximize the surface area across the bottom of the base 12. The larger surface area enhances retention of the pavement marker 10 in the bitumen or other adhesive applied to the surface of pavement.

Figure 11:
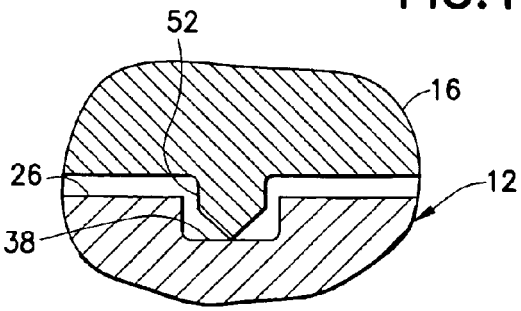
FIG. 11 is a cross-sectional view showing a nested rib and groove before welding.
Figure 12:
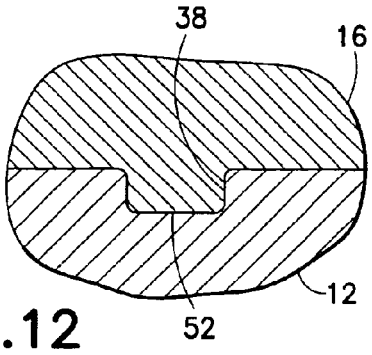
FIG. 12 is a cross-sectional view showing the rib and groove after welding.

The pavement marker 10 is assembled by telescoping the lenses 16 and 18 in the lens recesses 26 and 28 respectively and telescoping the bottom cover 14 into a recess 60 in the bottom 20 of the base 12, as shown in FIGS. 9–12. As a result; the energy directors 52 on the lenses 16, 18 nest in the grooves 38 in the lens recesses 26 and 28. Similarly the energy directors 68 on the top surface 66 of the bottom cover 14 nest with the grooves formed in the webs 64 on the bottom 20 of the base 12, as shown in FIG. 11. The assembled pavement marker 10 then is presented to an ultrasonic welding apparatus. More particularly, the ultrasonic welding apparatus includes a horn configured to align substantially with the energy directors 52 and 68. Pressure and ultrasonic energy then are applied by the horn so that the converging surfaces and the edge on each energy director 52 and 68 melt and fuse integrally with the plastic material surrounding the corresponding grooves 38, as shown in FIG. 12. Each groove 38 functions to chanelize and contain the molten plastic of the corresponding energy director 52. As a result, there is less spreading of the molten plastic material and more effective retention of the lenses 16 and 18 and the bottom cover 14 to the base 12.

The ultrasonic welding of at least the front lens 16 to the base 12 provides a very secure attachment that will withstand the forces imposed on the pavement marker 10 during normal usage. The retroreflective facets of the front lens 16 that are spaced from the energy directors 52 provide a strong nighttime signal in response to light impinging on the front lens 16 from the head light of a vehicle. The opaque fluorescent thermoplastic material from which the base 12 is molded will produce a strong daytime signal in response to ambient light. The retroreflective regions of the front lens 16 will not produce significant daytime signals. However, the energy directors 52 will produce a fluorescent daytime signal in response to ambient light impinging on the front lens 16. The fluorescent daytime signal produced by the energy directors 52 contributes to the daytime signal generated by the opaque fluorescent thermoplastic material of the base 12. The strength of the daytime signal contributed by the front lens 16 is a function of the density of the energy directors 52 on the rear surface 42 of the front lens 16.

In the preceding embodiment, the daytime signal produced by the front lens 16 is attributable to the fluorescence of the front lens 16 and to the fluorescence of the base 12 directly beneath the energy director 52 of the front lens 16. A daytime signal can be achieved by the energy directors 52 of the front lens even if the base 12 is formed from a non-fluorescent material. Similarly, a daytime signal can be achieved by the front lens 16 even if the front lens 16 is formed from a non-fluorescent material, provided that the base 12 is formed from a fluorescent material. In this latter regard, photons emitted from the fluorescent material in the base 12 will be emitted through the non-fluorescent translucent resin of the energy directors and will be visible during daylight to a driver approaching the front of the pavement marker 10.

As noted above, construction zones and school zones are areas where a daytime signal can be very helpful. Hence, the pavement marker of the subject invention with the enhanced daytime signal is particularly useful for construction zones, school zones and other areas where daytime caution is important. Thus, the dyes or colorants used in the lenses and the base can be a fluorescent orange for construction zones, a fluorescent yellow-green for school zones, or fluorescent yellow for other areas that require caution.

The preferred embodiments employ ultrasonic welding for attaching the lenses to the base. However, a daytime signal can be obtained with other methods of attachment, such as adhesive or mechanical fasteners.

The preferred embodiment shows a substantially planar surface with grooves in the lens recess. However, the lens recess can be formed with coring holes and webs between the coring holes. In these embodiments, top surfaces of the webs may be formed with grooves for receiving energy directing ribs of the lens. Alternatively, the webs may define the energy directors and the rear surface of the lens may have grooves or planar surface areas that will be ultrasonically welded to the webs.

The rear surface of the lens preferably has areas that are free of retroreflective facets to define daytime signal generators. The retroreflective facets may initially be formed on the entire rear surface of the lens, but may be destroyed locally by ultrasonic welding to create signal areas.

These and other variations of the preferred embodiment will be apparent to those skilled in the art and are encompassed by the invention as defined by the claims.

What is claimed is:

1. A roadway marker comprising a resin base having a bottom for mounting to a supporting surface and a front lens recess having a bottom edge substantially adjacent the bottom of the base and a top edge spaced rearwardly from the bottom edge so that the front lens recess is sloped at an acute angle relative to the bottom of the base, the front lens recess being formed with a plurality of grooves, a resin lens having a rear surface secured to the front lens recess of the base, the lens including at least one nighttime signal region with a plurality of retroreflective surfaces aligned for reflecting light from a headlight of a vehicle back toward the vehicle, the rear surface of the lens further being formed with a plurality of ribs nested in the grooves of the front lens recess and ultrasonically welded to the base so that the nested ribs and grooves define an integral matrix of resin, the resins of the lens and the base being formed from a resin having a fluorescent material therein such that ambient light impinging on the fluorescent material causes photons to be emitted through portions of the base ultrasonically welded to the lens and further emitted through the lens to define daytime signal regions on the lens.

2. The roadway marker of claim 1, wherein the fluorescent material in the lens is a fluorescent orange colorant.

3. The roadway marker of claim 1, wherein the fluorescent material in the lens is a fluorescent yellow-green colorant.

4. The roadway marker of claim 1, wherein the fluorescent material in the lens is a fluorescent yellow colorant.

5. The roadway marker of claim 2, wherein the fluorescent material in the base is fluorescent orange.

6. The roadway marker of claim 3, wherein the fluorescent material in the base is fluorescent yellow-green.

7. The roadway marker of claim 4, wherein the fluorescent colorant in the base is fluorescent yellow.

8. The roadway marker of claim 1, wherein the retroreflective surfaces are on the rear surface of the lens.

9. The roadway marker of claim 1, wherein the daytime signal region is free of retroreflective surfaces.

10. A roadway maker comprising a resin base having a bottom for mounting to a supporting surface and a front lens recess having a bottom edge substantially adjacent the bottom of the base and a top edge spaced rearwardly from the bottom edge so that the front lens recess is sloped at an acute angle relative to the bottom of the base, a front surface extending between the bottom and top edges of the front lens recess, a resin lens having a rear surface secured to the front surface of the front lens recess of the base, the lens including at least one nighttime signal region with a plurality of retroreflective surfaces aligned for reflecting light from a headlight of a vehicle back towards the vehicle, the rear surface of the lens and the front surface of the lens recess being provided with nested ribs and grooves, the nested ribs and grooves being ultrasonically welded together to define an integral matrix of resin, the resins of the lens and the base having a fluorescent material therein so that ambient light impinging on the fluorescent material causes photons to be emitted through portions of the base ultrasonically welded to the lens and further emitted through the lens to define daytime signal regions on the lens.

11. The roadway marker of claim 10, wherein the fluorescent material in the base and the lens is fluorescent orange.

12. The roadway marker of claim 10, wherein the fluorescent material in the base and the lens is fluorescent yellow-green.

13. The roadway marker of claim 10, wherein the fluorescent material in the base and the lens is a fluorescent yellow.

* * * * *